United States Patent [19]

Baitz

[11] 4,391,542

[45] Jul. 5, 1983

[54] DEVICE FOR THE STEPWISE FEED OF PRINTING MEDIA IN AN ELECTROMECHANICAL PRINT UNIT

[75] Inventor: Günter Baitz, Berlin, Fed. Rep. of Germany

[73] Assignee: Nixdorf Computer AG, Paderborn, Fed. Rep. of Germany

[21] Appl. No.: 245,300

[22] Filed: Mar. 19, 1981

[30] Foreign Application Priority Data

Apr. 15, 1980 [DE] Fed. Rep. of Germany ..... 3014430

[51] Int. Cl.[3] ..... B41J 11/50

[52] U.S. Cl. ..... 400/605; 400/625; 400/611; 400/618; 400/624

[58] Field of Search ..... 400/605, 610, 610.1, 400/610.3, 612, 611, 616, 617, 618, 624, 625, 642; 271/9

[56] References Cited

U.S. PATENT DOCUMENTS

| | | | |
|---|---|---|---|
| 1,386,969 | 8/1921 | Smith | 400/610.1 X |
| 3,656,602 | 4/1972 | Konkel et al. | 400/616.2 X |
| 4,168,038 | 9/1979 | Nims | 400/617 X |
| 4,189,135 | 2/1980 | Costa | 400/625 X |
| 4,212,456 | 7/1980 | Ruenzi | 400/625 X |
| 4,268,021 | 5/1981 | Rutishauser | 400/625 |
| 4,275,969 | 6/1981 | Matsuhisa et al. | 400/625 |

FOREIGN PATENT DOCUMENTS 2219077 10/1973 Fed. Rep. of Germany ... 400/616.2

OTHER PUBLICATIONS

Bateson et al., "Dual-Motor Forms Feed Drive", IBM Tech. Discl. Bulletin, vol. 22, No. 7, 12/79, pp. 2616–2617.

Rose, "Document Feed System", IBM Tech. Discl. Bulletin, vol. 22, No. 1, 6/79, p. 21.

*Primary Examiner*—E. H. Eickholt

*Attorney, Agent, or Firm*—Krass, Young & Schivley

[57] ABSTRACT

Sheet feeding accessories for a typewriter-type printing unit having a stepwise driven print roller. The single sheet feeder is pivotally mounted on the printing unit and the continuous sheet feeder is mounted piggyback style on the single sheet feeder. A drive belt commonly connects the print roller, the single sheet feeder, and the continuous sheet feeder.

18 Claims, 3 Drawing Figures

DEVICE FOR THE STEPWISE FEED OF PRINTING MEDIA IN AN ELECTROMECHANICAL PRINT UNIT

DESCRIPTION

TECHNICAL FIELD

The invention relates to a device for the stepwise conveying of printing media to an electromagnetic print unit, in which the respective recording support is moved with a stepping drive and a take-off device to a print position, in which a single sheet conveyer for conveying printing media in sheet form to the print position is provided.

BACKGROUND ART

The principle is already known of providing electromechanical print units with additional devices which make possible an automatic feed and removal of printing medias. Such an additional device is for example the above-mentioned single sheet conveyer which can be placed on the print unit and contains one or a plurality of receptacles for printing medias in sheet form. Assigned to the receptacles are separating mechanisms in the form of friction rollers which can be actuated by electromagnetic clutches through suitable control signals transmitted from the print unit and can pull out single sheets from the respective receptacle and convey them to the print position. Then the respective single sheet, after the recording of the information in the print unit, is removed from the print position again and deposited in a storage bin.

The single sheet conveyer to be attached to the electromagnetic print unit as an accessory is provided with a drive assigned individually to it and a control unit for controlling the drive and is controlled from the electromechanical print unit, for example by request signals. This gives rise to a relatively high mechanical and also electrical expenditure for the single sheet conveyer, because of which its extensive adoption has not yet been fully achievable.

Another additional device to be attached to electromechanical print unit is the continuous form conveyer with which printing medias in strip form can be pulled through a print unit, which have a perforation on their lengthwise edges in which the toothed tracks of two conveying units engage, which are also designated as Leporello conveyers. These continuous form conveyers in their use on electromechanical print units up to now have been used exclusively in the conveying direction of the printing media behind the print position, since they draw the strip-form printing media through the print unit so that when it comes out of the continuous form conveyer it can be deposited in a storage bin with zig-zag folding.

A relatively large amount of power was required up to now for driving the continuous form conveyer, since by the conveying principle of drawing a printing media through a print unit, the continuous form conveyer must expend not only the force required for merely conveying the printing media but in addition must also expend tensile force which is necessary in order to compensate for frictional effects caused by the repeated deflection of the printing media in the print unit. One disadvantage particularly important in this connection up to now was the increased danger of tearing out the perforations of the printing media due to the relatively high tensile force acting on its edges.

DISCLOSURE OF THE INVENTION

It is the task of the invention to supply a device which permits the introduction of single sheets and of continuous forms at will as printing medias in electrical print units in a trouble-free manner, and in changing over from one type of printing media to another requires no change in the drive position.

This problem is solved according to the invention, for a device of the type mentioned at the start, by having a continuous form conveyer with the same conveying direction as that of the single sheet feed, which is attachable to the single sheet conveyer, and the drive of which is coupled with the drive of the single sheet conveyer, and by having the take-off device contain conveying elements the circumference of which is dimensioned or provided in accordance with a continuously presecribed stress on the respective printing media.

The invention provides a novel type of application of a continuous form conveyer, since on the one hand it is not exchanged for the single sheet conveyer but rather is attached to it and on the other hand it is not used to draw the continuous form through the print unit, but rather it operates in the same direction as the single sheet feed, which means that in its state attached to the single sheet conveyer it does not pull but pushes the continuous form. This is possible because the take-off device arranged after the print position and provided for operation with single sheets can also take off the continuous form. Now when, in the case of continuous form operation, a step-by-step feed of the continuous form by the continuous form conveyer occurs, corresponding to the line-by-line recording in the print unit, then the continuous form conveyer requires only a drive force suitable for feeding the continuous form out of a storage place. Theoretically the feeding and taking off of the continuous form before and behind the print position of the print unit results in a slackening in the conduction of the continuous form. But when the conveying elements of the take-off device, which operates stepwise in synchronization with the conveying motion of the continuous form conveyer, take off the continuous form from the print position, then because of the slackening of the continuous form no addition force is required for this in any case in order to compensate for frictional effects occuring at deflection points. At these points merely the force required for the continuous stress prescribed is sufficient. This continuous stress can easily be achieved by having the conveying elements of the take-off device, which may be conveying rollers for example, show a diameter, if necessary in connection with a suitable surface, such that the required straight-line conducting of the continuous form occurs without any sagging or the conveying troubles resulting from this.

Thus the new type of application of the continuous form conveyer requires a lower expenditure of force for its driving. In this way, when the continuous form conveyer is attached to the single sheet conveyer it is possible to couple its drive to that of the latter.

The principle of the invention which provides no exchanging of the one conveyer for another, but rather utilizes the single sheet conveyer as a permanently installed accessory to which the continuous form conveyer can be attached when necessary, leads to a particularly advantageous further development inasmuch as the drive of the single sheet conveyer can be coupled with the stepping drive of the print unit. This makes any special drive devices in the region of the single sheet conveyer superfluous, and one may merely provide electromagnetic clutches with which the operation of the separating devices for the single sheet feeding is controlled. It has proven here that control signals for actuating such electromagnetic clutches need not necessarily be made with a special control logic assigned to the single sheet conveyer, but may be derived very simply from the logic control circuit already present in the electromechanical print unit, for which the circuit must be enlarged at a comparatively small additional expense, which is especially small compared with the expense that would be caused by a separate drive device with its own electronic control assigned to it.

An especially simple drive control for the single sheet conveyer, if necessary in connection with the continuous form conveyer, is made possible by the fact that the single sheet conveyer shows a cogged belt drive the belt of which is driven by way of a gear provided at the coupling point with the continuous form conveyer and by way of a gear provided at the coupling point with the print unit, which gear engages in a driving gear provided on the continuous form conveyer or in one provided in the print unit.

Further developments of the invention as well as the operation of an illustrative embodiment are described in the following on the basis of the figures.

DETAILED DESCRIPTION OF THE SPECIFIC EMBODIMENT

Figure 1:
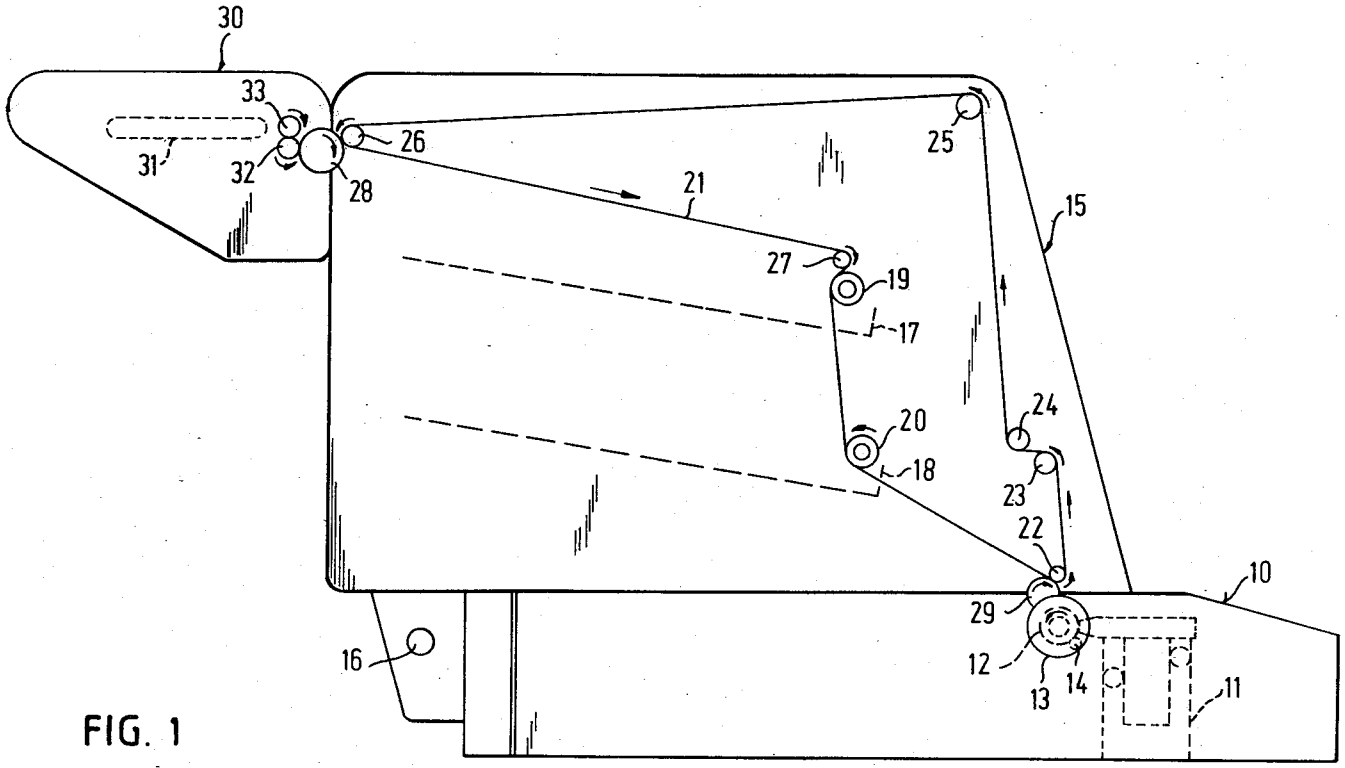
FIG. 1 shows a diagrammatic side view of an electromechanical print unit with single-sheet conveyer and continuous form conveyer attached to this.

In FIG. 1 represents, diagrammatically and in a side view, an electromechanical print unit 10 which in its interior contains a displaceably mounted printing head, for example a stylus printing head, which records information by lines on a printing medium such as paper not visible in FIG. 1, which support for this purpose is conveyed around a platen 12 represented in broken lines in FIG. 1 which can be adjusted manually with a handwheel 13 on the outside of the print unit 10.

An electromechanical stepping drive is used for driving the platen, and assigned to the platen 12, inside the print unit 10, are back-up rollers 14 which act on the recording support conveyed between them and the platen 12, so that during the stepwise motion of the platen 12 the support is conveyed line by line, as is known also for standard typewriters.

On the electromechanical print unit 10 is arranged as an accessory a single sheet conveyer 15 which is attached in pivotable form to the print unit 10 at 16, so that it can be swiveled out from the print unit 10 in a manner yet to be described.

The single sheet conveyer 15 contains storage receptacles 17 and 18 represented in broken lines in FIG. 1, in which printing medias in sheet form, e.g., those with different formats, may be stored, which can be withdrawn from the receptacles 17 and 18 and conveyed to the platen 12 in a manner yet to be described. For conveying sheets from the receptacles 17 and 18, separating devices may be provided in the interior of the single sheet conveyer 15 which devices may be actuated selectively with the electromagnetic clutches 19 and 20 provided on the outside of the single sheet conveyer 15. The electromagnetic clutches 19 and 20 are part of a drive system which includes as an essential component a cogged belt 21, diagrammatically represented with its path in FIG. 1, which is conveyed by toothed rollers 22, 23, 24, 25, 26 and 27 and is transported in the direction shown by the arrow in FIG. 1 when the toothed roller 22 additionally engages in a gear 29 which in turn is coupled with a gear which is seated on the shaft of the platen 12. In this manner, the step-by-step action of the platen 12 also leads to step-by-step action of the cogged belt 21, so that on throwing one of the electromagnetic clutches 19 and 20 in gear it causes the respectively assigned separating device likewise to move in a stepping motion and brings about a step-by-step conveying of a printing media in sheet form out of the receptacles 17 and 18.

The gear 29, which is mounted on the single sheet conveyer 15, is a coupling gear and is uncoupled when the single sheet conveyer 15 is swung out from the driving gear seated on the platen shaft.

The toothed roller 26, which carries the cogged belt 21 at a point near the back side of the single sheet conveyer 15, is so arranged that it comes into engagement with a drive gear 28 which belongs to a continuous form conveyer 30. The continuous form conveyer 30 contains at least two toothed belt drives, which is denoted in FIG. 1 by the broken line 31. Moreover further gears 32 and 33 coupled with the drive gear 28 are provided, which gears are mechanically connected to drives 31 in such a manner as to provide a suitable conveying direction and conveying speed of the continuous form conveyer 30.

The toothed rollers 23, 24 and 25, by way of which the cogged belt 21 is conveyed in the front part of the single sheet conveyer 15, are placed on the shafts of a take-off device which will be described further in the following.

The drive gear 28 of the continuous form conveyer 30 is arranged so that it engages in the toothed roller 26 of the cogged belt 21 when the continuous form conveyer 30 is attached to the single sheet conveyer 15. If the continuous form conveyer 30 is taken off, then the drive gear 28 becomes uncoupled from the toothed roller 26 of the cogged belt 21.

The representation in FIG. 1 makes it particularly clear that the driving of the two accessories, that is the single sheet conveyer 15 and the continuous form conveyer 30, is done by the stepping drive of the electromechanical print unit 10, so that therefore no separate drive and also no separate logic control is required for the single sheet conveyer 15 and for the continuous form conveyer 30. The electrical control signals required for actuating the electromagnetic clutches 19 and 20 may be derived from a logic control circuit which is already part of the electromechanical print unit 10.

Figure 2:
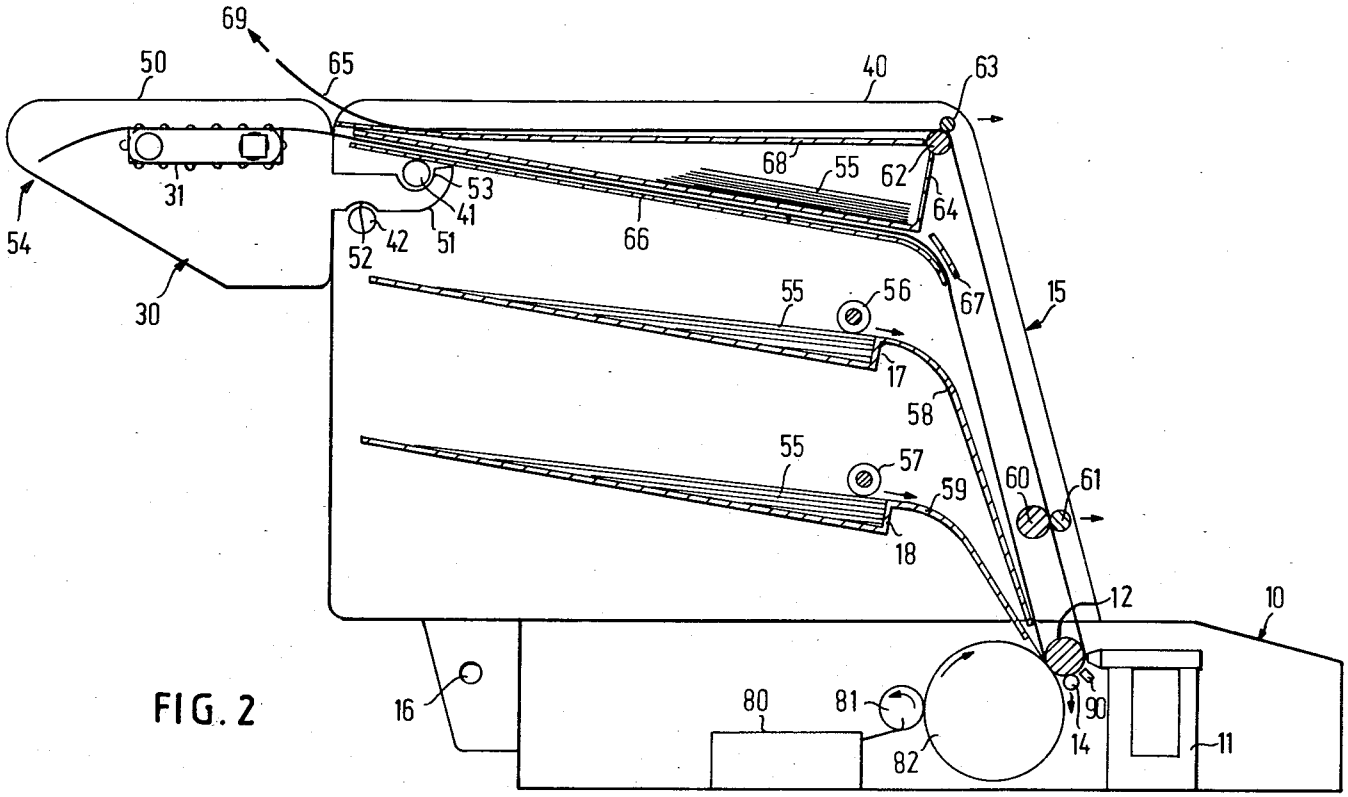
FIG. 2 shows a schematic sectional representation of the unit shown in FIG. 1.

In FIG. 2 is shown a diagrammatic sectional representation of the whole unit according to FIG. 1. This representation makes clear the principle of the internal construction of the three devices 10, 15 and 30 as assigned to one another. This principle corresponds to the usual construction in business machine technology with two lateral sidewalls between which the various moving elements are supported. Thus according to the sectional representation provided in FIG. 2 a sidewall 40 of the single sheet conveyer may be seen which is connected with the print unit 10, pivoting at 16, and shows two bolts 41 and 42 on which the one sidewall 50 of the continuous form conveyer is suspended by an arm 51 which is provided with recesses 52 and 53 suited for this purpose. A corresponding construction is also provided for the other side of the whole unit, which is not shown in the sectional representation of FIG. 2 and the outside of which is represented in FIG. 1.

In the electromechanical print unit 10 are provided not only the printing head 11 and the platen 12 but also a logic control circuit 80 connected with an electrical driving motor 81 as well as a main drive gear 82. The main drive gear 82 rotates the platen 12 step-by-step by way of another gear on the platen shaft, which gear is not represented in FIG. 2, for which purpose the driving motor 81 is accordingly driven step-by-step by the logic control circuit 80.

The sheet receptacles 17 and 18 contain printing medias 55 in sheet form which, upon the actuation of the separating devices 56 and 57 by the electromagnetic clutches 19 and 20 shown in FIG. 1, are conveyed to the platen 12 by way of a respective guide plate 58 and 59. Here, according to known business machine technology, they go between the platen 12 and the back-up rollers 14 and are guided around the platen 12 in a manner not represented further. Then they are taken off by a take-off device which consists of lower conveying and back-up rollers 60 and 61 as well as upper conveying and back-up rollers 62 and 63. The conveying rollers 60 and 61 are supported on shafts which are turned by the toothed rollers 23 and 24 shown in FIG. 1 by way of the cogged belt 21. Roller 62 is mounted on the shaft of wheel 25. The take-off device causes the printing media to be taken off of the platen 12 and deposited in a storage bin 64 when the printing medias in sheet form emerge from the gap between the conveying and back-up rollers 62 and 63.

The representation in FIG. 2 reproduces the above-described conveying of printing medias in sheet form only by way of suggestion, wherein the arrows provided in the separation devices 56 and 57 will be referred to. However the conveying route of a continuous form 65 is clearly represented, which at 54 is conveyed to the continuous form conveyer 30 and is taken up by its conveying devices 31. The continuous form then runs through a gap formed by the bottom of the take-up receptacle 64 and a guide plate 66. This guide plate is curved on its front edge in such a way that the continuous form 65 is guided downward. For this if necessary still another guide plate 67 may be provided. The continuous form then reaches the print position, for which purposes it is guided in an intrinsically known manner around the platen 12 and is conveyed in a manner not represented to the take-off device by the conveying and back-up rollers 60 and 61 or 62 and 63. The continuous form upon emerging from the gap between the rollers 62 and 63 is not however conducted into the sheet receptacle 64 but rather is guided by way of a deflector 68 to an outlet point 69 where it can be deposited in a known manner in approximately a zigzag folding. The deflector 68 may for example be designed in a lattice form and when the continuous form conveyer 30 is taken off of the single sheet conveyer 15, this deflector may likewise be removed, for which purpose it may be arranged in sliding guides (not represented) which are provided on the platens 40 of the single sheet conveyer.

The above described course of a continuous form 65 through the devices 10, 15 and 30 requires further guide surfaces not represented in FIG. 2, which are not necessary for an understanding of the invention and hence have not had to be further described here.

The back-up rollers 61 and 63 are releasable from their position shown in FIG. 2, as the arrows shown next to them denote. This may be advantageous in feeding a continuous form 65, into the machine in order to eliminate any directional errors occurring then, since the continuous form in emerging at 69 must be guided exactly parallel to its course to the input position 54. The alignment in the sense of such a parallel guiding is done by releasing the back-up rollers 61 and 62 and carrying out the conveying motion automatically.

The back-up roller 14 on the platen 12 must be released from the platen 12 in the continuous form drive, as is also represented by an arrow in FIG. 2. The release of the back-up rollers 14 from the platen 12 is advantageous because the continuous form 65 is drawn through the take-off device exclusively with the rollers 60, 61, 62 and 63 and is pushed through the continuous form conveyer 30. As was already explained, this conveying principle requires only a slight conveying force for the continuous form 65, since the tension on the continuous form 65 is not so great that high frictional losses would occur due to its repeated deflection. The diameters of the conveying rollers 60 and 62 of the take-off device are chosen such that there is exactly no sagging of the continuous form 65 when it is fed through the continuous form conveyer 30. If necessary the surface of the conveying rollers 60 and 62 can be covered with a material which allows a certain slippage between the conveying rollers 60 and 62 and the continuous form 65 as soon as a limiting value of the tensile stress on the continuous form 65 is exceeded.

Directly before the print position, at which the printing head 11 acts on the respective recording support located on the platen 12, a photoelectric unit 90 is denoted diagrammatically. This may for example be an arrangement consisting of a light transmitter and a light receiver, which emits an electrical signal when the reflectance of the surface opposite it varies, i.e., when the dark platen surface is covered by a printing media and the edge of the latter moves past the photoelectric unit 90. The signal emitted by this can then be advantageously utilized for triggering the logic control circuit 80 of the print unit in the direction of starting the printing process. With earlier single sheet conveyers, which operate with a drive especially assigned to them and their own logic control circuit, the removal of printing medias in sheet form was detected at the sheet receptacle itself, and then the time within which the forward edge of a sheet must reach the print position was determined by digital counting. This led to a further increase in electronic expenditure on the single sheet conveyer and to imprecision in the start of the printing at least, since when the sheets are conveyed between the sheet receptacles and the print position, mechanical effects and conveying troubles can occur which are not detected by a counting process independent of the conveying motion. The arrangement of the photoelectric unit 90 directly before the print position insures that regardless of conveying delays the appearance of a sheet edge directly before the print position can be signaled accurately. Since the single sheet conveyer 15 has no logic control circuit of its own but is controlled by the logic control circuit 80 of the print unit 10, and moreover its driving is done by the stepping drive 81 of the print unit 10, troubles and imprecision in the sheet conveying, which were unavoidable with the previous assemblies of print units and single sheet conveyers, are excluded by the derivation of control criteria directly before the print position.

Figure 3:
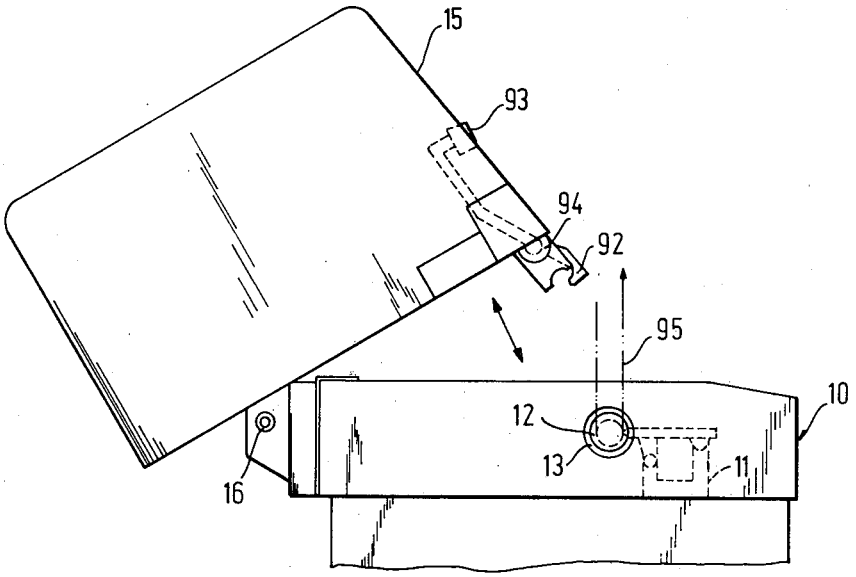
FIG. 3 shows a reduced side view of the device in an operating position which permits the manual insertion of recording supports.

FIG. 3, in a reduced view, shows one operating position of the device with the endless belt conveyer 30 removed. The single sheet conveyer 15 has been swung out of 16 from the print unit 10 in such a way that the platen 12 is accessible from above in order to insert a printing media in sheet form manually in somewhat the way it is done in a standard typewriter. This is denoted by the dot-dash line 95.

In the swung-out position FIG. 3 also shows a claw device 92 which can be actuated by a hand lever 93 provided on the other side of the single sheet conveyer 15, in order to uncouple it from the shaft of the platen 12. A claw device 92 of this type with hand lever 93 may be provided on both sides of the single sheet conveyer 15 and it is advantageous for it to be provided with a prestressed spring 94 which will tension the claw device 92 in such a way that it is always held firmly onto the shaft of the platen 12.

As a deviation from the embodiment example described above, the take-off device advantageously may also be designed with endless conveyer belts instead of the rollers 60 to 63, where the conveyer belts are conveyed respectively adjacent to one another in pairs and which take up the respective printing medias between them. The dimensioning of this type of conveying elements is done in accordance with the diameter of conveying rollers 60 and 62, analogously to the comments above, and here the guide rollers provided for the endless conveyer belts must be dimensioned accordingly.

A construction according to the invention can be used in connection with print units of any type. In particular, a platen is unessential for the mode of operation of the device described. Thus, for example, typewriters which instead of a platen have a stationary writing bar as support piece, for a stylus writing head perhaps, amy also be equipped with the device according to the invention.

I claim:

1. For use with an electromechanical printer (10) of the type having a print unit in which printing media (55,65) is moved through the printing unit by a stepping drive roller (12) and in which a drive take-off means (60,61) is provided down stream in the direction of printing media movement:

- a single sheet printing media conveyor (15) attached as an accessor to the printer (10); and
- a continuous form printing media conveyor (30) having drive means (28) attached to the single sheet printing media conveyor (15) as a further accessory;
- a drive belt (21) commonly interconnecting the stepping drive roller (12), the take-off means (60,61), the single sheet conveyor (15) and the continuous form conveyor drive means (28) for synchronous operation in the same feed direction; the take-off means (60,61) having rollers of such circumference in engagement with the printing media so as to maintain tension on the printing media when fed therethrough.

2. Device as claimed in claim 1, characterized in that the stepping drive roller (12) is provided with back-up rollers (14) which are detachable from the roller (12) for recording on continuous forms media (65).

3. Device as claimed in claim 2, further including a drive means (81,82) coupled to the roller (12).

4. Device as claimed in claim 3, characterized in that the single sheet conveyor (15) is provided with a cogged belt drive (21, 22 to 27) the belt (21) of which is conveyed over a gear (22,26) provided at the coupling point with the continuous form conveyor (30) and one provided at the coupling point with the printer (10), which gear engages in a drive gear provided on the continuous form conveyor or one provided on the print unit (10), if necessary by way of an intermediate gear (23).

5. Device as claimed in claim 4, characterized in that the drive gear provided on the print unit (10) is placed on the shaft of the platen.

6. Device as set forth in claim 1, characterized in that the take-off means comprises first and second normally contacting rollers (60,61) of which the second roller (61) is a back-up roller and is detachable at will from the pressure applying position.

7. Device as claimed in claim 1, characterized in that the single sheet conveyor (15) is mounted pivoting on the printer (10) in such a way that by swinging out it releases the print unit (10) for manual sheet feeding and printing operation.

8. Device as claimed in claim 7, further comprising normally releasable means (92) for locking the single sheet conveyor (15) onto the printer (10).

9. Device as claimed in claim 1, characterized in that the single sheet conveyor (15) contains at least one sheet receptacle (17,18), preferably inclined downward in the direction of the conveying motion, for printing media (55) in sheet form, with a separating device (56,57) assigned to it, which can be coupled with the drive belt (21) by means of an electromagnetic clutch (19,20).

10. Device as claimed in claim 9, further including logic control means (80) in the printer (10) for producing signals which control the respective electromagnetic clutches (19,20).

11. Device as claimed in claim 1, characterized in that immediately next to the printing plane of the print unit is arranged an electro-optical unit (90) which is aligned with a printing media (55) fed to the printing plane.

12. Device as claimed in claim 11, characterized in that the electro-optical unit (90) is connected with the logic control unit (80) of the print means.

13. Device as claimed in claim 1, characterized in that a plurality of sheet receptacles (17,18) are provided, preferably for different sheet formats.

14. Device as claimed in claim 9, characterized in that over the sheet receptacle or receptacles (17,18) is provided a transport path (66) essentially parallel to these for a continuous form (65) coming out of the continuous form conveyor (30), to which path is linked a downward guide (67) with which the continuous form (65) is guided on a route converging with the conveying route (58,59) for printing media (55) in sheet form in the direction to the print position.

15. Device as claimed in claim 14, characterized in that a common take-off route is provided for printing media (55) in sheet form and for continuous forms (65).

16. Device as claimed in claim 1, wherein the continuous form conveyor (30) includes side walls (50) and the single sheet conveyor (15) includes side walls (40), the device being further characterized in that the continuous form conveyor (30) is provided with supporting arms (51) on its side platens (50) which arms are equipped with recesses (52,53) for suspension between bolts (41,42) which are provided on the side platens (40) of the single sheet conveyor (15).

17. Device as claimed in claim 7, characterized in that the single sheet conveyor (15) arranged on the print unit (10), near its lower rear edge, is attached in pivoting form onto the back side of the print unit (10) by means of a swiveling device (16).

18. The device set forth in claim 1 wherein the connection between the roller (12) and the belt (21) is accomplished by means of an intermediate roller (29).

* * * * *